US007029327B2

(12) United States Patent
Devine

(10) Patent No.: US 7,029,327 B2
(45) Date of Patent: Apr. 18, 2006

(54) WATERTIGHT DEVICE FOR CONNECTING A TRANSMISSION LINE CONNECTOR TO A SIGNAL SOURCE CONNECTOR

(75) Inventor: Edward B. Devine, Calumet City, IL (US)

(73) Assignee: Andrew Corporation, Orland Park, IL (US)

( * ) Notice: Subject to any disclaimer, the term of this patent is extended or adjusted under 35 U.S.C. 154(b) by 300 days.

(21) Appl. No.: 10/067,179

(22) Filed: Feb. 4, 2002

(65) Prior Publication Data

US 2003/0148660 A1 Aug. 7, 2003

(51) Int. Cl.
*H01R 13/40* (2006.01)

(52) U.S. Cl. ..... 439/587

(58) Field of Classification Search ..... 439/578–585, 439/271

See application file for complete search history.

(56) References Cited

U.S. PATENT DOCUMENTS

| | | | | |
|---|---|---|---|---|
| 3,634,815 A | | 1/1972 | Stevens et al. | 439/578 |
| 3,854,789 A | | 12/1974 | Kaplan | 439/584 |
| 4,173,385 A | | 11/1979 | Fenn et al. | 439/528 |
| 4,720,271 A | | 1/1988 | Grange | 439/271 |
| 4,763,132 A | | 8/1988 | Juds et al. | 333/248 |
| 5,154,636 A | * | 10/1992 | Vaccaro et al. | 439/583 |
| 5,340,332 A | | 8/1994 | Nakajima et al. | 439/584 |
| 5,439,386 A | | 8/1995 | Ellis et al. | 439/578 |
| 5,595,502 A | | 1/1997 | Allison | 439/583 |
| 5,795,188 A | | 8/1998 | Harwath | 439/583 |
| 5,938,474 A | * | 8/1999 | Nelson | 439/583 |
| 5,975,951 A | | 11/1999 | Burris et al. | 439/585 |
| 6,019,635 A | * | 2/2000 | Nelson | 439/583 |
| 6,102,738 A | * | 8/2000 | Macek et al. | 439/584 |
| 6,109,964 A | | 8/2000 | Kooiman | 439/578 |
| 6,133,532 A | * | 10/2000 | Lundback et al. | 439/578 |
| 6,146,197 A | | 11/2000 | Holliday et al. | |
| 6,217,380 B1 | | 4/2001 | Nelson et al. | |

* cited by examiner

*Primary Examiner*—Briggitte R. Hammond
(74) *Attorney, Agent, or Firm*—Barnes & Thornburg

(57) ABSTRACT

A device for connecting and sealing between a transmission line connector and a signal source connector includes a hollow outer conductor with an inner conductor disposed therein, and an electrical insulator disposed therebetween. One end of the outer conductor and an adjacent end of the inner conductor define a signal input connectable to the signal source connector, and opposite ends of the two conductors define a signal output connectable to the transmission line connector. The electrical insulator is hermetically sealed to the inner and outer conductors to prevent water ingress from the signal input to the signal output and vice versa. Optionally, a liquid sensor may be disposed between the inner and outer conductors to monitor the liquid content within the device.

18 Claims, 5 Drawing Sheets

WATERTIGHT DEVICE FOR CONNECTING A TRANSMISSION LINE CONNECTOR TO A SIGNAL SOURCE CONNECTOR

FIELD OF THE INVENTION

The present invention relates generally to electrical connecting devices for use with coaxial transmission lines, and more specifically to such devices configured to prevent water ingress.

BACKGROUND AND SUMMARY OF THE INVENTION

Electrical connectors for use in connecting coaxial transmission lines to a variety of signal sources are known and have been widely used for decades. One particular application of such connectors involves connecting a signal receiving antenna to a coaxial transmission line, and one such known communication signal receiving arrangement 10 is shown in FIG. 1. Referring to FIG. 1, signal receiving arrangement 10 includes a tower 12 having an antenna 14 affixed thereto, wherein antenna 14 may be a dipole, microwave or other known antenna type. A coaxial electrical connector 16 is connected at one end to a matingly configured electrical connector coupled to antenna 14, and at its opposite end to a coaxial transmission line 18. Transmission line 18 is typically routed to a base station 20 located adjacent to tower 12 where signal evaluation and diagnostics are performed before providing the received signal to users via an output coaxial transmission line 22.

Connector 16 and antenna 14 each define complementarily or matingly configured electrical connection structures such that connector 16 may be electrically connected to antenna 14 in a structurally secure manner. An example of one such connector 16 is described in U.S. Pat. No. 5,595,502 to Allison, which is assigned to the assignee of the present invention, and the disclosure of which is incorporated herein by reference. In this embodiment, the electrical connector coupled to antenna 14 is matingly configured to receive the '502 connector in both an electrically contacting and structurally secure manner.

The present invention provides a device for connecting and sealing between a coaxial transmission line connector and a signal source connector, wherein the device is configured to prevent liquid ingress.

The present invention further provides for an electrical connector having a liquid sensor disposed therein producing a signal indicative of the liquid content within the connector.

These and other objects of the present invention will become more apparent from the following description of the preferred embodiment.

DESCRIPTION OF THE PREFERRED EMBODIMENTS

Figure 1:
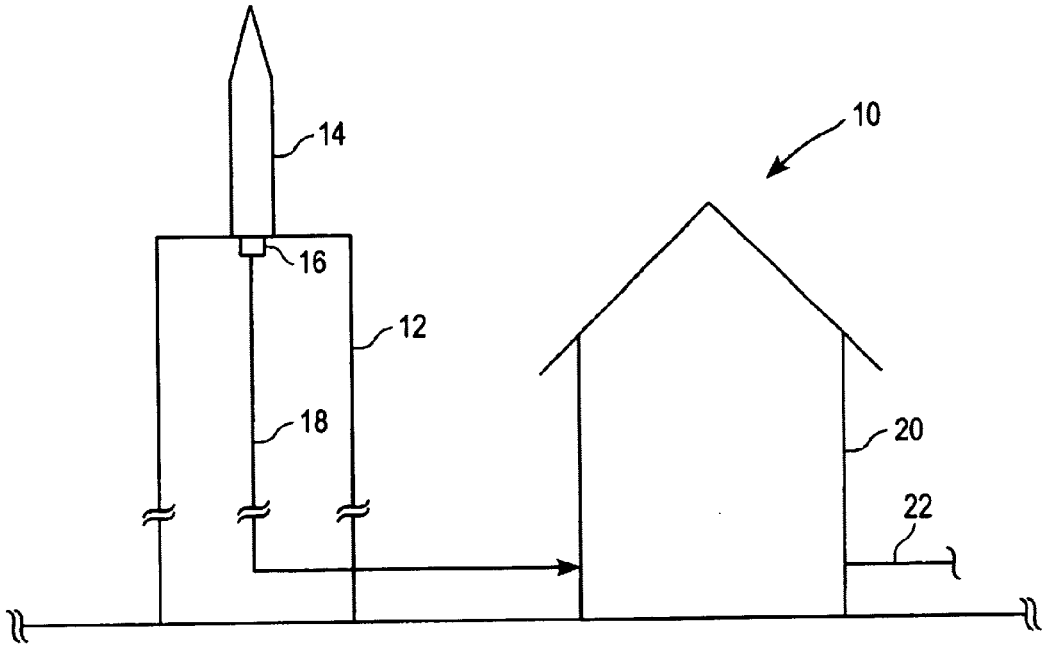
FIG. 1 (PRIOR ART)
FIG. 1 is a diagrammatic illustration of a known communication signal receiving arrangement showing a prior art electrical connector connecting a signal-receiving antenna to a coaxial transmission line.

For the purposes of promoting an understanding of the principles of the invention, reference will now be made to a number of preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

Figure 2:
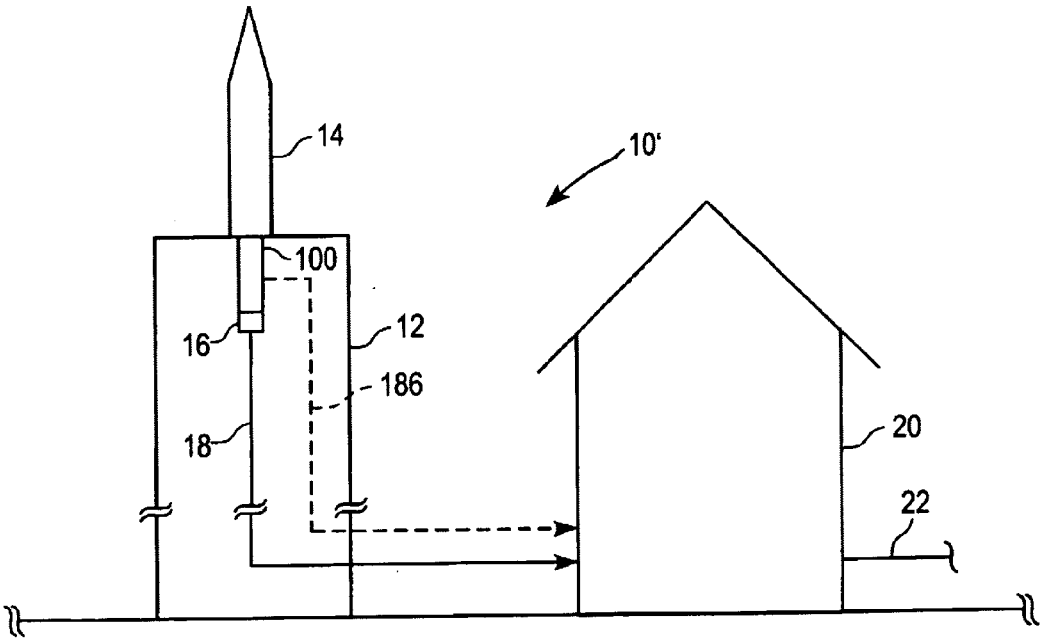
FIG. 2 is a diagrammatic illustration of a communication signal receiving arrangement similar to that of FIG. 1 implementing a device for connecting and sealing between the signal receiving antenna connector and the coaxial transmission line connector, in accordance with the present invention.

Referring to FIG. 2, a communications signal receiving arrangement 10', similar to arrangement 10 show in FIG. 1, implementing a device 100 for connecting and sealing between an electrical connector of antenna 14 and transmission line connector 16, in accordance with the present invention, is shown. Signal receiving arrangement 10' is similar in many respects to arrangement 10 illustrated in FIG. 1, and like numbers are therefore used to identify like elements. As with arrangement 10, signal receiving arrangement 10' includes a tower 12 having an antenna affixed thereto, wherein antenna 14 may be a dipole, microwave or other known antenna type. In the embodiment shown in FIG. 2, the device 100 of the present invention is connected at one end to an electrical connector coupled to antenna 14, and at its opposite end to a coaxial transmission line connector 16 that is itself electrically coupled to a transmission line 18. Transmission line 18 is routed to a base station 20 located adjacent to tower 12, where signal evaluation and diagnostics are performed before providing the received signal to users via an output coaxial transmission line 22. Optionally, as shown in phantom in FIG. 2, a diagnostic signal line 186 may also be electrically connected between device 100 and base station 20.

Figure 3:
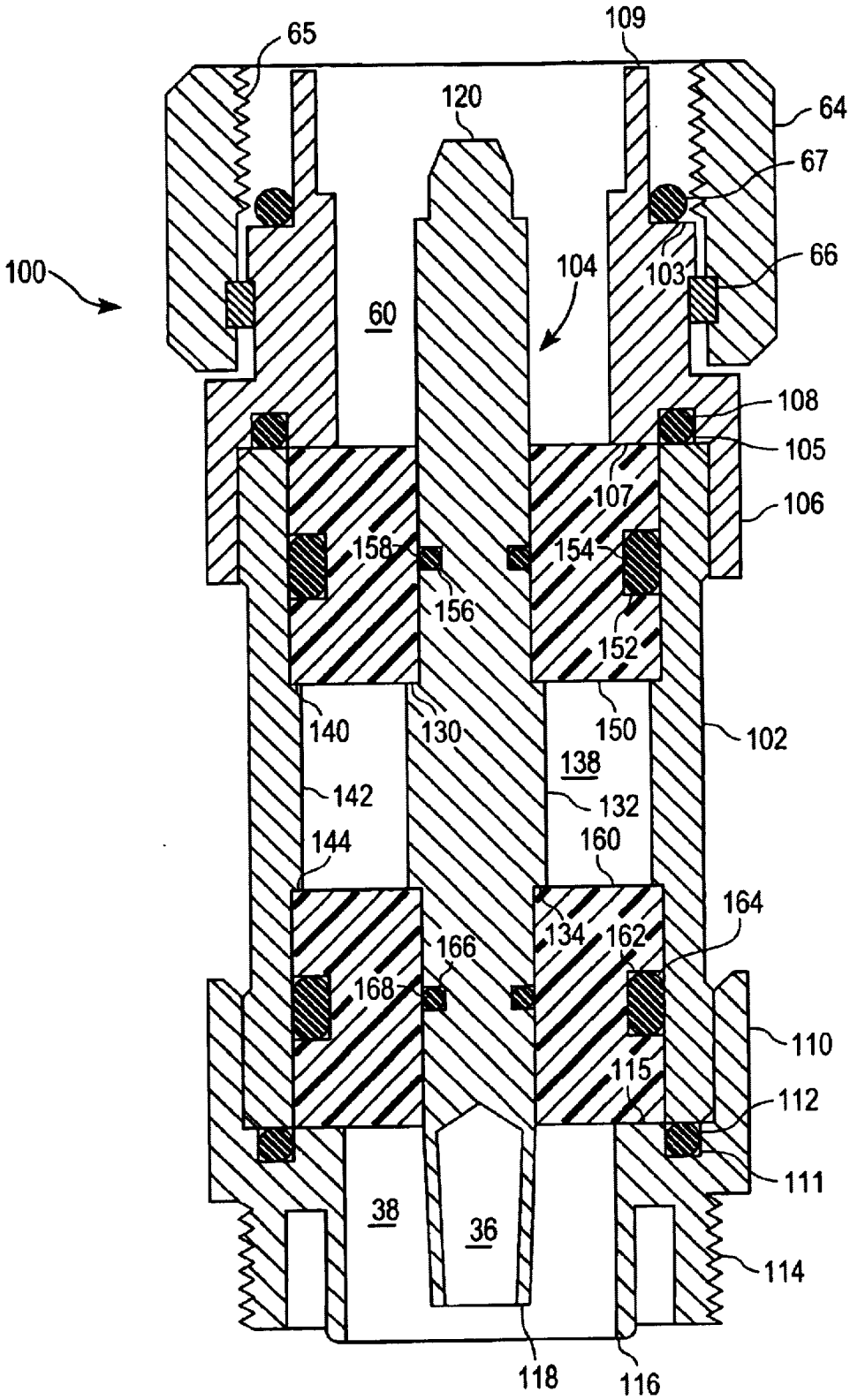
FIG. 3 is a cross-sectional view of one preferred embodiment of the device of FIG. 2.

Referring now to FIG. 3, a cross sectional view of one preferred embodiment of the device 100 of FIG. 2, in accordance with the present invention, is shown. Device 100 includes an elongated hollow outer conductor 102 with an elongated inner conductor 104 disposed therein. A first hollow, electrically conductive end piece 106 is affixed, and electrically connected, to one end of the outer conductor 102. End piece 106 defines a channel 105 therein adjacent to the interface with outer conductor 102, and a flexible sealing member 108 is disposed within channel 105 to form a water tight or hermetic seal between outer conductor 102 and conductive end piece 106 when end piece 106 is affixed thereto. In one embodiment, flexible sealing member 108 is an O-ring formed of a silicon-based rubber or similar material, although the present invention contemplates that sealing member 108 may alternatively be formed in other shapes and of other suitable materials.

A second hollow, electrically conductive end piece 110 is affixed, and electrically connected, to an opposite end of outer conductor 102. Like end piece 106, end piece 110 defines a channel 111 therein adjacent to the interface with outer conductor 102. A sealing member 112 is disposed within channel 111 and creates a water tight or hermetic seal between end piece 110 and outer conductor 102 when end piece 110 is affixed thereto. Like sealing member 108, sealing member 112 may be a flexible O-ring formed of a silicon-based rubber or other material having similar properties, although the present invention contemplates that sealing member 112 may alternatively be formed in other shapes and of other suitable materials.

Inner conductor 104 defines a step 130 to a cross-sectionally wider portion 132, and outer conductor 102 defines a similar step 140 to a cross-sectionally wider portion 142. A first electrical insulator 150 is positioned between the outer conductor 102 and the inner conductor 104 with one end thereof in contact with stepped portions 130 and 140 of inner conductor 104 and outer conductor 102 respectively. An opposite end of insulator 150 is in contact with face 107 of end piece 106 such that insulator 150 is confined in the position shown in FIG. 3 by steps 130 and 140 of inner conductor 104 and outer conductor 102 respectively, and face 107 of end piece 106. In one embodiment, electrical insulator 150 is formed of TPX or PTFE, although the present invention contemplates that insulator 150 may alternatively be formed of other known electrically insulating materials. The outer surface of insulator 150 defines a channel 152 therein extending completely around an outer periphery of insulator 150 in a direction perpendicular to the longitudinal axis of connector 100. A sealing member 154 is disposed within channel 152 in contact with insulator 150 and outer connector 102 such that it creates a water tight or hermetic seal therebetween. The inner surface of insulator 150 defines a second channel 156 therein extending completely around an inner periphery of the insulator 150 in a direction perpendicular to the longitudinal axis of connector 100. A second sealing member 158 is disposed within channel 156 in contact with inner conductor 104 and insulator 150 such that it creates a water tight or hermetic seal therebetween. In one embodiment, sealing members 154 and 158 are O-rings formed of a silicon-based rubber or other material having similar properties, although the present invention contemplates that sealing members 154 and 158 may alternatively be formed in other shapes and of other suitable materials.

Inner conductor 104 defines another step 134 to cross-sectionally wider portion 132 and outer conductor 102 defines an adjacent step 144 to cross-sectionally wider portion 142 as shown in FIG. 3. A second electrical insulator 160 is positioned between the outer conductor 102 and the inner conductor 104 with one end of insulator 160 in contact with steps 134 and 144 of inner conductor 104 and outer conductor 102 respectively. An opposite end of insulator 160 is in contact with face 115 defined by end piece 110 such that insulator 160 is confined in the position shown in FIG. 4 by steps 134 and 144 of inner conductor 104 and outer conductor 102 respectively, and face 115 of end piece 110. As with electrical insulator 150, insulator 160 is formed of TPX or PTFE, although the present invention contemplates that insulator 160 may alternatively be formed of other known electrically insulating materials.

An outer surface of insulator 160 defines a first channel 162 therein extending completely around an outer periphery of insulator 160 in a direction perpendicular to the longitudinal axis of connector 100. A sealing member 164 is disposed within channel 162 in contact with insulator 160 and outer conductor 102 to create a water tight seal therebetween. The inner surface of insulator 160 defines a second channel 166 therein extending completely around the inner periphery of insulator 160 in a direction perpendicular to the longitudinal axis of connector 100. A sealing member 168 is disposed within channel 166 in contact with inner conductor 104 and insulator 160 to create a water tight or hermetic seal therebetween. As with sealing members 154 and 158, sealing members 164 and 168 are in one embodiment formed of a silicon-based rubber or other material having similar properties, although the present invention contemplates that sealing members 164 and 168 may alternatively be formed in other shapes and of other suitable materials.

While insulators 150 and 160 are illustrated in FIG. 3 as each defining single channels in their outer peripheries and single channels in the inner peripheries, it is to be understood that the inner and/or outer peripheries of each of insulators 150 and 160 may alternatively define any number of channels therein with suitable sealing members disposed within such channels to create additional water tight or hermetic seals between insulators 150 and 160 and the outer and inner conductors 102 and 104 respectively. Alternatively, the channels defined in the inner and outer peripheries of each of the insulators 150 and 160 may be omitted, and the sealing members 154, 158, 164 and 168 replaced with a suitable adhesive or other formable medium operable to hermetically seal insulators 150,160 to the outer and inner conductors 102 and 104 respectively. In any case, the outer and inner conductors 102 and 104 respectively of connector 100 define an open cavity 138 therebetween which extends between insulator 150 and insulator 160.

One end 118 of the inner conductor 104 extends away from the insulator 160 toward one end 116 of the end piece 110. The insulator 160, end piece 110 and inner conductor 102 define a cavity 38 therebetween adjacent end 116. A portion 114 of end piece 110 is threaded adjacent end 116, and is configured to receive in threaded engagement a complementarily threaded portion of a transmission line connector 16. End 118 of inner conductor 104 also defines a cavity 36 therein that is sized to receive in electrically contacting relationship one conductor of transmission line connector 16, wherein the transmission line connector 16 may be of the type described U.S. Pat. No. 5,595,502, previously incorporated herein by reference. End 118 of inner conductor 104, cavity 38 and end piece 110 thus define a signal output of device 100 that is, in one embodiment, identical to an electrical connector coupled to antenna 14 so that the signal output end of device 100 may be readily connected to transmission line connector 16. It is to be understood, however, that the present invention contemplates other structural configurations of the signal output end of device 100, and such other structural configurations are intended to fall within the scope of the present invention.

The opposite end 120 of the inner conductor 104 extends away from insulator 150 toward end 109 of end piece 106. Insulator 150, inner conductor 104 and end piece 106 define cavity 60 therebetween adjacent end 109 of end piece 106. A coupling nut 64 is received over end 109 of end piece 106 with a retaining ring 66 disposed therebetween. In this embodiment, an inner surface 65 of coupling nut 64 is threaded, and is configured to receive in threaded engagement a complementarily threaded portion of an electrical connector coupled to antenna 14. A sealing member 67 is disposed between the coupling nut 64 and end piece 106 in contact with surface 103 of end piece 106, and may be formed identically as described hereinabove with respect to sealing members 108 and 112. In one embodiment, sealing member 67 is a flexible O-ring having an outer diameter sized slightly less than the distance between coupling nut 64 and end piece 106 such that electrical connection between an electrical connector coupled to antenna 14 and device 100 deforms member 67 sufficiently to create water tight or hermetic seal between coupling nut 64 and end piece 106.

End 120 of inner conductor 104, cavity 60, end piece 106 and coupling nut 64 thus define a signal input of device 100 that is, in one embodiment, configured identical to the electrical connector 16 so that the signal input end of device 100 may be readily connected to a matingly configured electrical connector coupled to antenna 14. It is to be understood, however, that the present invention contemplates other structural configurations of the signal input end of device 100, and such other structural configurations are intended to fall within the scope of the present invention.

From the foregoing, it should now be apparent that device 100 is configured at each of its signal input and signal output ends identically to the corresponding terminal structures an existing transmission line connector 16 and antenna 14 respectively, such that device 100 may be easily and readily installed therebetween. Such an installation simply requires unthreading the existing transmission line connector 16 from the matingly configured electrical connector coupled to antenna 14, threading the coupling nut 64 onto the now-exposed antenna electrical connector and threading the transmission line connector 16 onto end piece 110. Device 100 is configured to prevent water ingress from the signal input end thereof, or from outside of device 100, into the signal output end thereof, as well as water ingress from the signal output end thereof, or from outside of device 100, into the signal input end thereof. Water or moisture directed from antenna 14 into the cavity 60 of device 100 is accordingly prevented from seeping into cavity 38 and/or transmission line 18. It is to be understood that while the signal input and output ends of device 100 have been illustrated and described as having specific electrical and mechanical connection structures, such structures are provided only by way of example to illustrate connection to one known structure of an electrical connector coupled to antenna 14 and transmission line connector 16. The present invention contemplates that device 100 may alternatively be configured for connection between other known configurations of the electrical connector coupled to antenna 14 and transmission line connector 16, and any corresponding modifications to the signal input and output ends of device 100 that are required to accommodate such alternate antenna 14 and transmission line 16 connector structures are intended to fall within the scope of the present invention.

Figure 4:
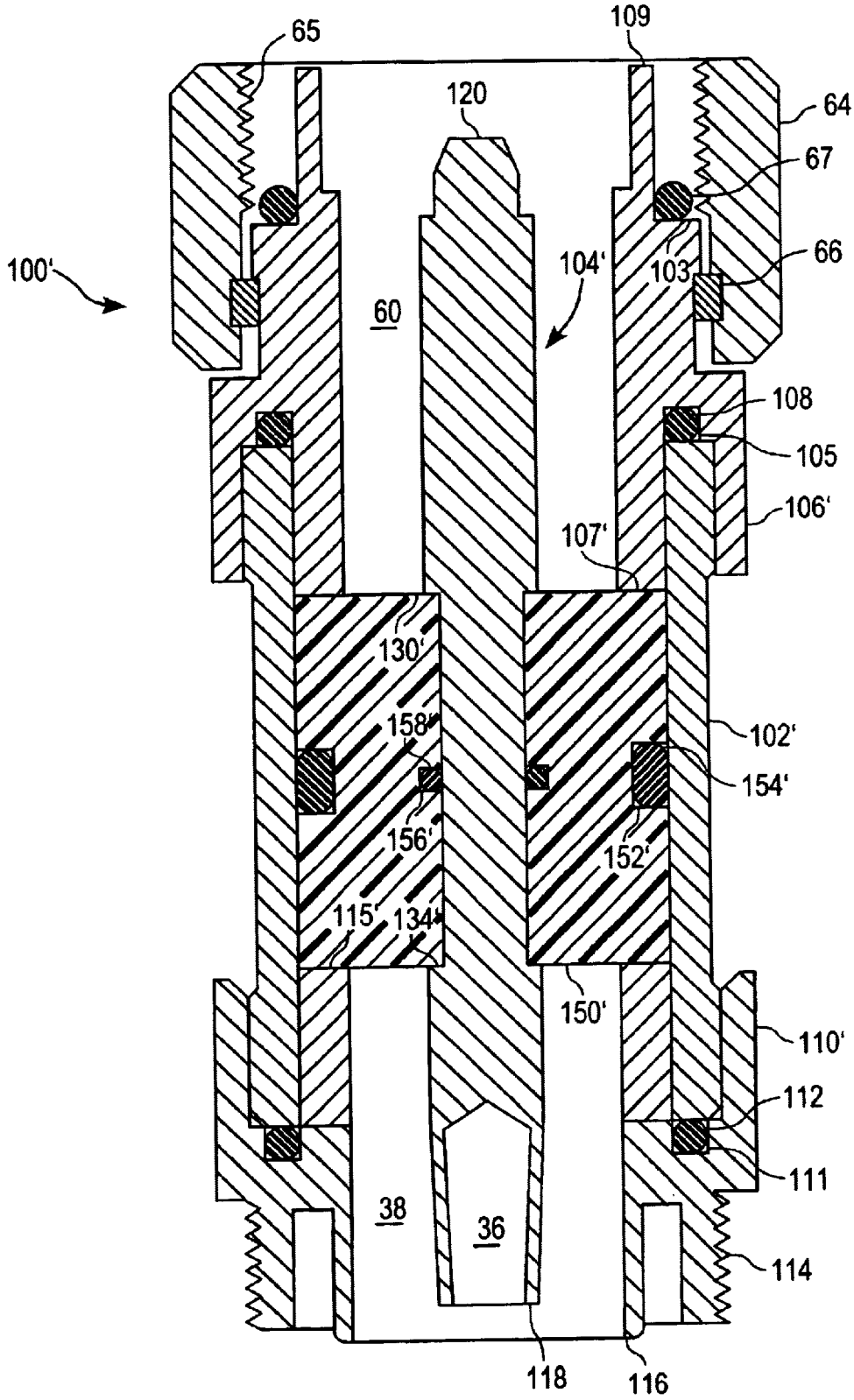
FIG. 4 is a cross-sectional view of an alternate embodiment of the device of FIG. 2.

Referring now to FIG. 4, a cross-sectional view of an alternate embodiment 100' of the device 100 illustrated in FIG. 2, in accordance with the present invention, is shown. Device 100' is identical in many respects to device 100 illustrated in FIG. 3, and like numbers will therefore be used to identify like elements. Unlike device 100, device 100' includes only a single electrical insulator 150' disposed between outer conductor 102' and inner connector 104'. In this regard, inner conductor 104' defines a first step 130' adjacent cavity 60 and a second step 134' adjacent cavity 38. Insulator 150' is confined in the position shown in FIG. 4 by channels 130' and 134' of inner conductor 104', and by face 107' of end piece 106' and face 115' of end piece 110'. In one embodiment, an outer surface of insulator 105' defines a first channel 152' therein extending completely around the outer periphery of insulator 150' in a direction perpendicular to the longitudinal axis of connector 100'. A sealing member 154' is disposed within channel 152' in contact with electrical insulator 150' and outer conductor 102' to form a water tight or hermetic seal therebetween. Similarly, the inner surface of insulator 150' defines a second channel 156' therein extending completely around the inner periphery of insulator 150' in a direction perpendicular to the longitudinal axis of connector 100'. A second sealing member 158' is disposed with in channel 156' in contact with insulator 150' and inner conductor 104' to create a water tight or hermetic seal therebetween. Material choices for electrical insulator 150' and sealing members 152' and 158' are as described with respect to FIG. 3.

While insulator 150' is illustrated in FIG. 4 as defining a single channel in its outer periphery and a single channel in its inner periphery, it is to be understood that the inner and/or outer peripheries of insulator 150' may alternatively define any number of channels therein with suitable sealing members disposed within such channels to create additional water tight or hermetic seals between insulator 150' and the outer and inner conductors 102' and 104' respectively. Alternatively, the channels defined in the inner and outer peripheries of the insulator 150' may be omitted, and the sealing members 154' and 158' replaced with a suitable adhesive or other formable medium operable to hermetically seal insulator 150' to the outer and inner conductors 102' and 104' respectively.

Figure 5:
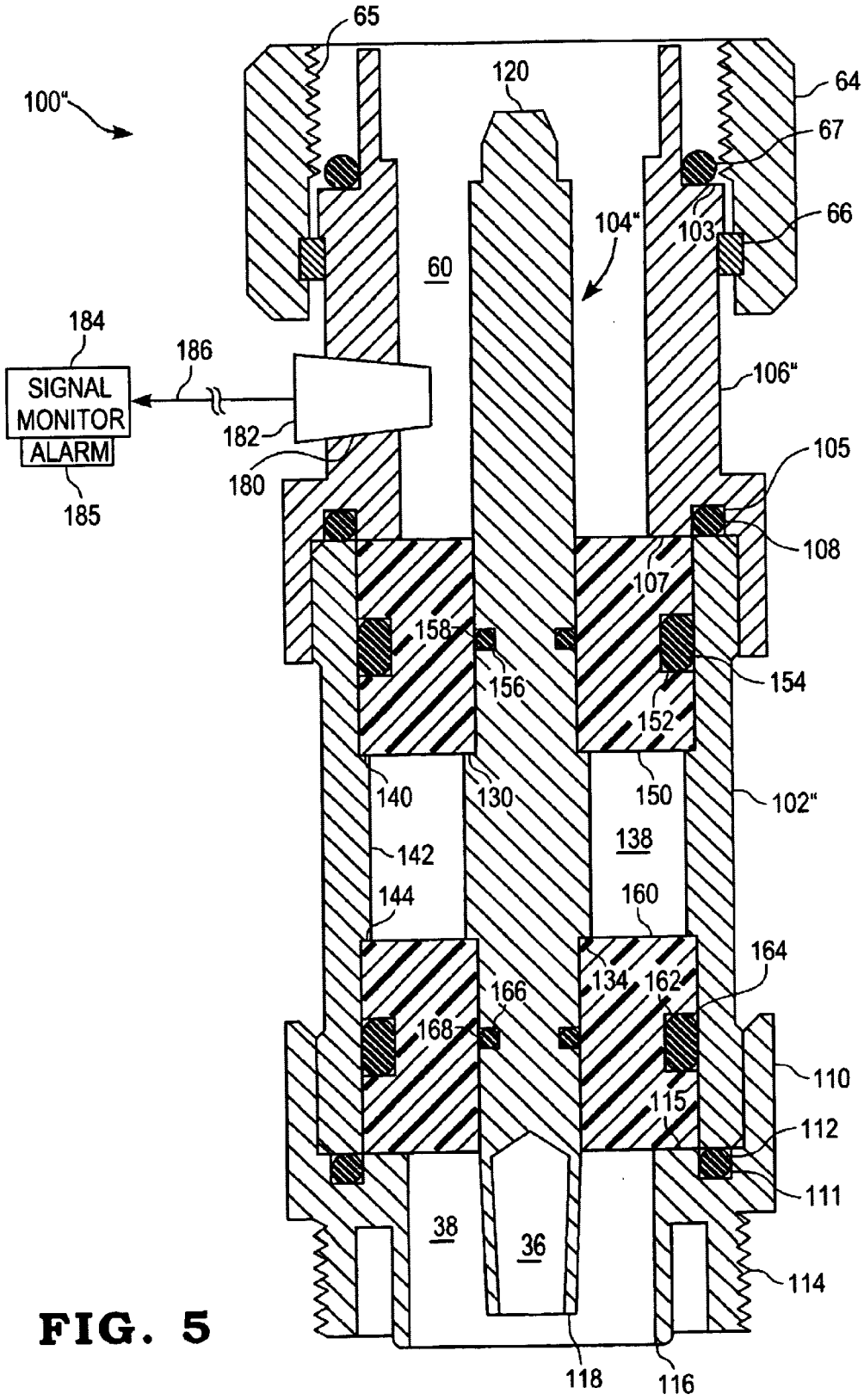
FIG. 5 is a cross-sectional view of another alternate embodiment of the device of FIG. 2.

Referring now to FIG. 5, a cross-sectional view of another alternative embodiment 100" of the device 100 shown in FIG. 2, in accordance with the present invention, is shown. Device 100" is identical in many respects to device 100 shown and described with respect to FIG. 3, and like numbers will therefore be used to identify like elements. In device 100", end piece 106" is elongated beyond that illustrated in FIG. 3, such that cavity 60 is likewise elongated. In this embodiment, end piece 106" defines a passageway 180 extending therethrough to cavity 60. A liquid sensor 182 of known construction is received within the passageway 180, and in one embodiment it extends into cavity 60. Alternatively, sensor 182 may be recessed within passageway 180. In either case, liquid sensor 182 is in fluid communication with cavity 60. Liquid sensor 182 is electrically connected to a signal monitor 184 via signal path 186 (as shown in phantom in FIG. 2). In one embodiment, liquid sensor 182 is a moisture sensor of known construction and operable to produce a signal on signal path 186 indicative of the moisture content within cavity 60. Alternatively, liquid sensor 182 may be a liquid level sensor of known construction and operable to produce a signal on signal path 86 indicative of the liquid level with in cavity 60. In general, liquid sensor 182 is thus operable to produce a signal on signal path 86 indicative of liquid intrusion into cavity 60, and in this regard sensor 182 may be any known sensor operable to provide such information to signal monitor 184. In one embodiment, signal monitor 184 is located within the base station 20 (see FIG. 2), although the present invention contemplates that signal monitor 184 may be located adjacent to device 100", mounted to tower 12, or positioned at any desirable location adjacent or remote to device 100". In any case, signal monitor 184 may be of known construction and operable to monitor the signal on signal path 186 and activate an alarm 185 when the signal produced by sensor 182 is above a signal threshold, which is indicative that the liquid content within cavity 60 is above a liquid threshold. Alarm 185 may be integral with, or remote from, signal monitor 184.

While device 100" is illustrated in FIG. 5 as having a liquid sensor 182 disposed in fluid communication with cavity 60, those skilled in the art will recognize that passageway 180 may alternatively defined through outer conductor 102" such that sensor 182 is in fluid communication with cavity 138, and/or end piece 110 may be elongated similarly to end piece 106" with passageway 180 defined therethrough such that liquid sensor 182 is disposed in fluid communication with cavity 38. One or more liquid sensors 182 may thus be implemented with device 100" to thereby monitor the liquid content of any one or more of cavity 60, cavity 138 and cavity 38. Additionally, while device 100" is illustrated in FIG. 5 as including two electrical insulators 150 and 160 and associated sealing members 154, 158, 164 and 168, those skilled in the art will recognize that device 100" may alternatively be configured with a single electrical insulator as illustrated and described hereinabove with respect to FIG. 4.

In any of the embodiments of the device of the present invention illustrated in FIGS. 3, 4, and 5, end piece 110 and end 118 of inner conductor 104 (or 104' or 104") define a signal output of the device that is configured for electrical connection to a coaxial transmission line connector 16 as described hereinabove. End piece 106 (or 106' or 106"), end 120 of inner conductor of 104 (or 104' or 104") and coupling nut 64, by contrast, define a signal input of the device of the present invention that is configured for electrical connection to an electrical connector coupled to antenna 14 as described hereinabove. However, the present invention further contemplates that the signal input end of the device of the present invention may alternatively be configured for electrical connection to other signal sources. For example, referring to FIG. 6, a cross-sectional view of a variant 100'" of the device 100 of FIG. 2, in accordance with the present invention, is shown. Variant 100'" is identical in many respects to device 100 illustrated in FIG. 3, and like reference numbers will therefore be used to identify like elements. Unlike device 100 of FIG. 3, however, end piece 106 of device 100'" is replaced by an end piece 110 identical to end piece 110 forming the signal output end of the device 100. Likewise, the end 118' of inner conductor 104" defines a cavity 36 therein identical to cavity 36 of device 100 within end 118 of inner conductor 104'" defining the signal output end of device 100'". In this embodiment, end 116' of end piece 110 and end 118' of inner conductor 104'" thus define a cavity 38 identical to cavity 38 of the signal output end of device 110'". The signal input and signal output ends of device 110'" are thus structurally identical, and device 110'" may accordingly be used in-line anywhere along transmission lines 18 or 22 (see FIG. 2) as a transmission line coupling connector.

Figure 6:
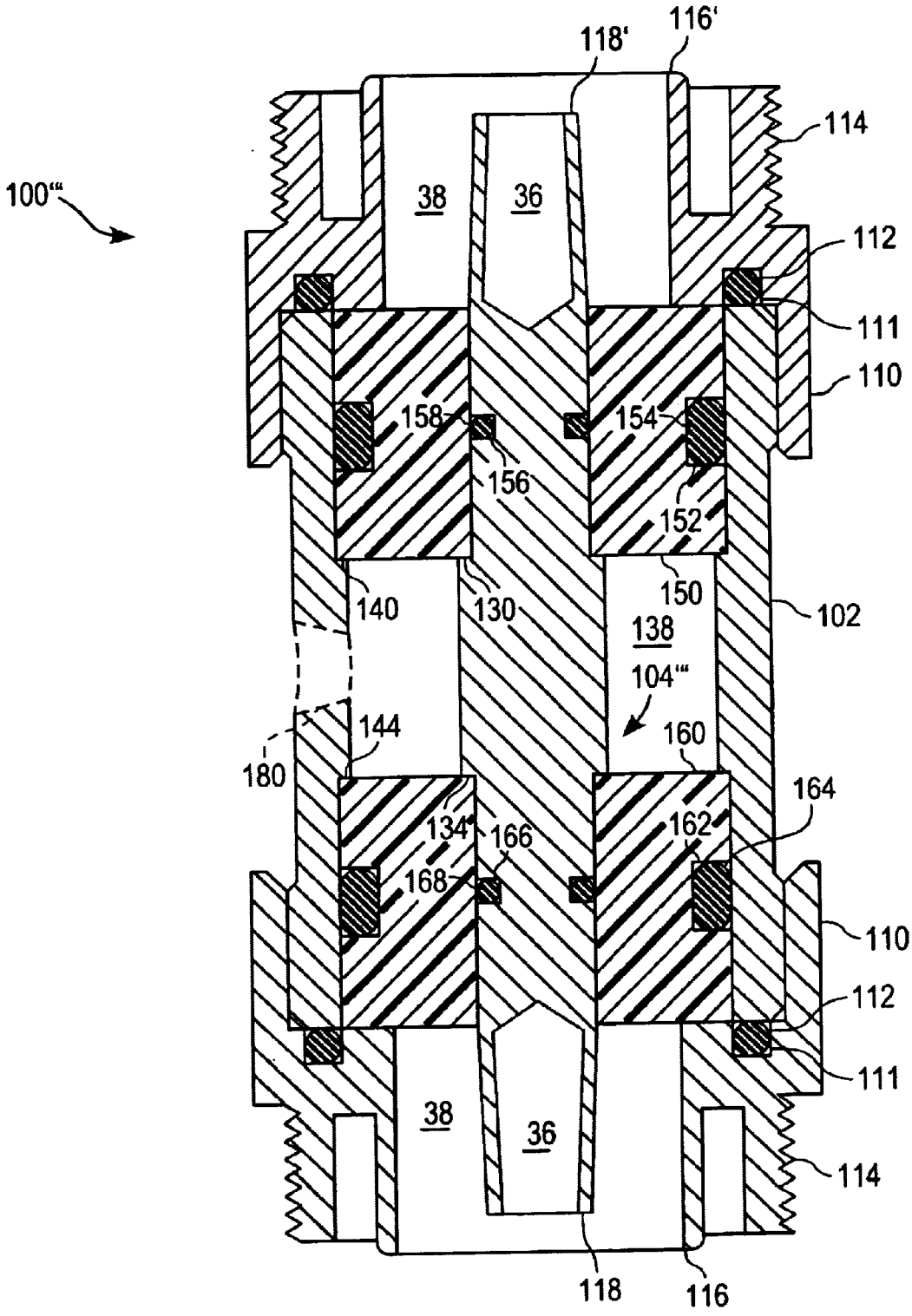
FIG. 6 is a cross-sectional view of a variant of the device of FIG. 2 configured for in-line electrical connection between two coaxial transmission lines.

As shown in phantom in FIG. 6, outer conductor 102 may define a passageway 180 therethrough extending into channel 138 such that a liquid sensor 182 may be received within passageway 180 to monitor the liquid content of cavity 138 as described hereinabove with respect to FIG. 5. Additionally or alternatively, either of the end pieces 110 forming the signal input and signal output ends of device 100'" may be elongated such that a passageway 180 may be defined therethrough extending into either cavity 38, wherein a liquid sensor 182 may be disposed in fluid communication with cavity 38 at either the signal input end or signal output end of device 100'". Liquid content monitoring of any one or more of cavity 138 and cavities 38 defining each of the signal input and signal output ends of device 100'" may thus be accomplished. It should further be understood that while device 100'" of FIG. 6 is illustrated as including two electrical insulators 150 and 160, with corresponding sealing members 154, 158, 164 and 168, such insulators 150 and 160 may alternatively be replaced by a single insulator 150' and corresponding sealing members 154' and 158' as illustrated and described hereinabove with respect to FIG. 4.

From the foregoing, it should now be apparent that device 100'" is configured identically at each of its signal input and signal output ends in a manner that is complementary to the terminal structure of existing transmission line connector 16 such that device 100'" may be easily and readily installed in-line between two such connectors 16. Device 100'" is configured to prevent water ingress from the signal input end thereof, or from outside of device 100'", into the signal output end thereof, as well as water ingress from the signal output end thereof, or from outside of device 100'", into the signal input end thereof. Device 100'" may accordingly be used as an inline connection device to prevent the transfer of water or moisture between connectable ends of a coaxial signal transmission line. It is to be understood that while the signal input and output ends of device 100'" have been illustrated and described as having specific electrical and mechanical connection structures, such structures are provided only by way of example to illustrate connection to one embodiment of a known transmission line connector 16 structure. The present invention contemplates that device 100'" may alternatively be configured for connection between other known transmission line connector 16 terminal structures, and any corresponding modifications to the signal input and output ends of device 100'" that are required to accommodate such alternate transmission line 16 terminal structures are intended to fall within the scope of the present invention.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

What is claimed is:

1. A device for connecting and sealing between a transmission line connector and a matingly configured signal source connector, the device comprising:

a hollow body forming an outer conductor and defining a longitudinal axis therethrough;

an inner conductor extending through said outer conductor along said longitudinal axis, one end of said outer conductor and a corresponding end of said inner conductor adjacent thereto defining a signal input of said device, and opposite ends of said outer conductor and said inner conductor defining a signal output of said device;

a first electrical insulator disposed between said inner and outer conductors;

a first water tight seal between the first electrical insulator and the inner conductor;

a second water tight seal between the first electrical insulator and the outer conductor;

the first and second water tight seals being substantially centered on a line extending generally perpendicularly through the longitudinal axis;

wherein said signal input of said device is configured for connection to said signal source connector and said signal output of said device is configured for connection to said transmission line connector, and wherein an axially extending outer surface of said first electrical insulator defines a first channel therein extending completely around an outer periphery of said first electrical insulator in a direction generally perpendicular to said longitudinal axis, with a first sealing member disposed within said first channel.

2. The device of claim 1 wherein said signal source is an antenna.

3. The device of claim 1 wherein said signal source is another transmission line.

4. The device of claim 1 wherein an inner surface of said first electrical insulator defines a second channel therein extending completely around an inner periphery of said first electrical insulator in a direction perpendicular to said longitudinal axis, with a second sealing member disposed within said second channel.

5. The device of claim 4 wherein said first and second sealing members are flexible sealing rings.

6. The device of claim 1 including third and fourth water tight seals located on a line extending generally perpendicularly through the longitudinal axis.

7. The device of claim 1 including at least one additional electrical insulator between the inner and outer conductors.

8. The device of claim 1 including a sensor detecting moisture in a portion of the device.

9. The device of claim 1 wherein the outer conductor includes at least one shoulder in abutment with the first electrical insulator preventing relative movement in one longitudinal direction.

10. The device of claim 9 wherein the inner conductor includes at least one shoulder in abutment with the first electrical insulator preventing relative movement in one longitudinal direction.

11. In combination:

a transmission line having attached thereto a first connector configured for connection to a second connector associated with a signal source; and a fluid blocking device configured at one end for connection to said first connector and at an opposite end for connection to said connector, said device comprising inner and outer conductors separated by an insulator watertight sealed to said inner and outer conductors by at least two seals substantially centered on a line extending generally perpendicularly through the transmission line, said device preventing transfer of liquid between said first and second connectors, and wherein an axially extending outer surface of said insulator defines a first channel therein extending completely around an outer periphery of said insulator in a direction generally perpendicular to said longitudinal axis, with a first sealing member disposed within said first channel.

12. The combination of claim 11 wherein said signal source is an antenna.

13. The combination of claim 11 wherein said signal source is another transmission line.

14. The combination of claim 11 wherein said fluid blocking device further includes:

a first sealing member positioned between said insulator and said outer conductor creating said watertight seal therebetween; and a second sealing member positioned between said insulator and said inner conductor creating said watertight seal therebetween.

15. The combination of claim 14 wherein said first and second sealing members are flexible sealing rings.

16. A device for connecting and sealing between a transmission line connector and a matingly configured signal source connector, the device comprising:

a hollow body forming an outer conductor and defining a longitudinal axis therethrough;

an inner conductor extending through said outer conductor along said longitudinal axis, one end of said outer conductor and a corresponding end of said inner conductor adjacent thereto defining a signal input of said device, and opposite ends of said outer conductor and said inner conductor defining a signal output of said device;

an electrical insulator disposed between said inner and outer conductors, the electrical insulator having an axially extending outer surface;

a channel in the axially extending outer surface;

a first water tight seal between the electrical insulator and the inner conductor;

a second water tight seal between the electrical insulator and the outer conductor;

the first and second water tight seals being located on a line extending generally perpendicularly through the longitudinal axis;

wherein said signal input of said device has one of an internal screw thread or external screw thread for connection to said signal source connector and signal output of said device has a screw thread for connection to said transmission line connector which is the opposite the one of an internal screw thread or external screw thread of the signal input.

17. A device for connecting and sealing between a transmission line connector and a matingly configured signal source connector, the device comprising:

a hollow body forming an outer conductor and defining a longitudinal axis therethrough;

an inner conductor extending through said outer conductor along said longitudinal axis, one said end of said conductor and a corresponding end of said inner conductor adjacent thereto defining a signal input of said device, and opposite ends of said outer conductor and said inner conductor defining a signal output of said device;

a first electrical insulator disposed between said inner and outer conductors;

a first water tight seal between the first electrical insulator and the inner conductor;

a second water tight seal between the first electrical insulator and the outer conductor;

the first and second water tight seals being located on a line extending generally perpendicularly through the longitudinal axis;

wherein said signal input of said device is configured for connection to said signal source connector and said signal output of said device is configured for connection to said transmission line connector;

wherein the outer conductor includes at least one shoulder in abutment with the first electrical insulator preventing relative movement in one longitudinal direction;

wherein he inner conductor includes at least one shoulder in abutment with the first electrical insulator preventing relative movement in one longitudinal direction; and wherein the at least one outer conductor shoulder and the at least one inner conductor shoulder are located on a line extending generally perpendicaularly through the longitudinal axis.

18. The device of claim 17 including a second electrical insulator spaced from the first electrical insulator.

* * * * *